US012239219B1

(12) United States Patent
Packer et al.

(10) Patent No.: US 12,239,219 B1
(45) Date of Patent: Mar. 4, 2025

(54) TEXTURED SENSORY DEVICE

(71) Applicant: Gyre & Gimble Gidgets Inc., Murray, UT (US)

(72) Inventors: Edward Packer, Murray, UT (US); Lia Packer, Murray, UT (US)

(73) Assignee: Gyre & Gimble Gidgets Inc., Murray, UT (US)

( * ) Notice: Subject to any disclaimer, the term of this patent is extended or adjusted under 35 U.S.C. 154(b) by 0 days.

(21) Appl. No.: 18/656,829

(22) Filed: May 7, 2024

(51) Int. Cl.
*A47B 21/03* (2006.01)

(52) U.S. Cl.
CPC ..... *A47B 21/0371* (2013.01)

(58) Field of Classification Search
CPC ..... A47B 21/0371
See application file for complete search history.

(56) References Cited

U.S. PATENT DOCUMENTS

| | | | | |
|---|---|---|---|---|
| 5,971,148 | A | 10/1999 | Jackson | |
| 6,195,255 | B1 * | 2/2001 | Kim | G06F 1/1616 361/679.19 |
| 6,385,037 | B2 | 5/2002 | Howell et al. | |
| 6,462,937 | B1 | 10/2002 | Liao et al. | |
| 6,963,486 | B2 * | 11/2005 | Kwitek | G06F 1/1616 361/679.55 |
| 7,077,015 | B2 * | 7/2006 | Hayward | G06V 40/13 73/862.041 |
| 11,419,249 | B1 | 8/2022 | Shawl | |
| 2001/0011998 | A1 | 8/2001 | Agata et al. | |
| 2001/0038524 | A1 | 11/2001 | Howell et al. | |
| 2002/0099312 | A1 * | 7/2002 | Smith | A47B 21/0371 601/131 |
| 2004/0062589 | A1 * | 4/2004 | Kim | G06F 1/1684 400/472 |
| 2008/0142672 | A1 | 6/2008 | Tran | |

(Continued)

FOREIGN PATENT DOCUMENTS

| | | | |
|---|---|---|---|
| EP | 1887453 A2 | 9/2007 | |
| GB | 2268396 A * | 1/1994 | A47B 21/0371 |

(Continued)

OTHER PUBLICATIONS

Gyre & Gimble Pencil Gidgets-Textured Silicone Pencil Sleeve sold on amazon, first available date: Oct. 1, 2023, https://www.amazon.com/Gyre-Gimble-Gidgets-Textured-Fidgeting-Transform-Tranquility/dp/BOCGY147QY (Year: 2023).* https://www.beyondplay.com/ITEMS/E658.HTM Sensory mats from Beyondplay.com dated by archive.org to be Feb. 25, 2024 (Year: 2024).*

(Continued)

*Primary Examiner* — Eret C McNichols
*Assistant Examiner* — Ding Y Tan
(74) *Attorney, Agent, or Firm* — Headland Law & Strategy; Matthew J. Smyth

(57) ABSTRACT

A sensory device may include a bottom surface, a perimeter wall extending upward from the bottom surface to a perimeter height and a plurality of projections extending upward from the bottom surface to a projection height. The plurality of projections may include a first set, a second set, and a third set, where projections within a given set have a similar structure to each other but a distinct structure relative to projections in other sets. Projections may be (a) generally cylindrical in shape, (b) disposed in a linear manner, (c) disposed as a plurality of concentric circular segments, or (d) disposed as a plurality of coupled linear segments.

17 Claims, 8 Drawing Sheets

(56) References Cited

U.S. PATENT DOCUMENTS

| | | | | |
|---|---|---|---|---|
| 2009/0149698 | A1* | 6/2009 | Tastard | A61M 21/00 472/133 |
| 2011/0141673 | A1 | 6/2011 | Takakusaki | |
| 2012/0171651 | A1* | 7/2012 | Renzelman | G09B 23/28 434/262 |
| 2014/0360069 | A2 | 12/2014 | Chadwick | |
| 2017/0014595 | A1 | 1/2017 | Heath | |
| 2019/0361543 | A1 | 11/2019 | Zhang | |
| 2022/0054796 | A1 | 2/2022 | McGreevy | |
| 2022/0193365 | A1* | 6/2022 | Toole | A61M 21/02 |
| 2022/0379162 | A1* | 12/2022 | Way | A63B 21/4037 |
| 2023/0008794 | A1* | 1/2023 | Brundidge | A47B 21/0371 |
| 2023/0027217 | A1 | 1/2023 | Aurongzeb et al. | |
| 2023/0321391 | A1 | 11/2023 | Bynum | |

FOREIGN PATENT DOCUMENTS

| | | | |
|---|---|---|---|
| JP | 2001092581 A | * | 4/2001 |
| WO | 1992011623 | | 7/1992 |

OTHER PUBLICATIONS

Gersoniel textured sensory stickers sold on amazon.com, first available date: Jan. 30, 2022, https://www.amazon.com/Anxiety-Stickers-Textured-Adhesives-Classroom/dp/B09RJ2DJ6X (Year: 2022).*

Calm strips Shark Tank pitch video posted by Sony Pictures Television dated Apr. 8, 2023 https://www.youtube.com/watch?v=IJpOvKFpdX8 (Year: 2023).*

TickiT Silishapes sensory circles tactile pads sold on amazon dated Feb. 21, 2018 https://www.amazon.com/TickiT-SiliShapes-Sensory-Circle-Set/dp/B079ZF6DYV (Year: 2018).*

TFH USA special needs toy online product page for tactile circles of model 9TSBV with earliest dated Jun. 18, 2021 by archive.org, https://specialneedstoys.com/usa/tactile/black-silver.html (Year: 2021).*

Matweb online material property data sheet for silicone rubber dated by archive.org at Nov. 12, 2020 , https://www.matweb.com/search/DataSheet.aspx?MatGUID=cbe7a469897a47eda563816c86a73520 (Year: 2020).*

* cited by examiner

TEXTURED SENSORY DEVICE

TECHNICAL FIELD

Various implementations relate generally to textured sensory devices. Some implementations relate to textured palm or wrist rests that may be used with portable computing devices.

BACKGROUND

Some students and other users of computing devices may be anxious or easily distracted. For some such students, having a textured or contoured surface may minimize anxiety and bring about greater levels of focus.

SUMMARY

Described herein are implementations of a textured sensory device with various surfaces and raised elements that may provide tactile and auditory feedback to a user. For example, various surfaces may provide a user with different tactile sensations when touched, and some surfaces may provide auditory feedback when manipulated.

A sensory device may include a bottom surface, a perimeter wall extending upward from the bottom surface to a perimeter height, and a plurality of projections extending upward from the bottom surface to a projection height. The plurality of projections may include a first set of first projections, a second set of second projections, and a third set of third projections. Each of the first projections in the first set may have a similar first structure, each of the second projections in the second set may have a similar second structure, and each of the third projections in the third set may have a similar third structure. The first structure, the second structure, and the third structure may be distinct from each other, and each set of projections may be selected from (a) projections being generally cylindrical in shape, (b) projections having a substantially uniform width and substantially uniform height and being disposed in a linear manner, (c) projections having a substantially uniform width and substantially uniform height and being disposed as a plurality of concentric circular segments, or (d) projections having a substantially uniform width and substantially uniform height and being disposed as a plurality of coupled linear segments. Each linear segment in the plurality of coupled linear segments may be disposed at a fixed angle relative to an adjacent linear segment in the plurality of coupled linear segments.

In some implementations, the fixed angle is about 120 degrees. In some implementations, the fixed angle is between 75 and 150 degrees. The sensory device may include one or more contoured surfaces. Each projection in the plurality of projections may be made of an elastic, resilient material. In some implementations, the elastic, resilient material is silicone. The silicone may have a Shore A durometer of 30-65.

The sensory device may be a three-dimensional palm or wrist rest configured for use with a keyboard associated with a portable computing device. A height of the three-dimensional rest relative to the bottom surface may vary along a width, such that a height along one long edge has a first value, and a height along a second long edge opposite the first long edge has a second value, which second value may be greater than the first value. In some implementations, the three-dimensional rest includes a first portion, a second portion, and a connecting region that couples the first portion to the second portion. The connecting region may include an opening that is configured to reveal a track pad associated with the portable computing device.

DETAILED DESCRIPTION

Described herein are implementations of a sensory device with various textured surfaces and raised elements that may provide tactile and auditory feedback to a user. For example, various surfaces may provide a user with different tactile sensations when touched, and some surfaces may provide auditory feedback when manipulated.

Figure 1:
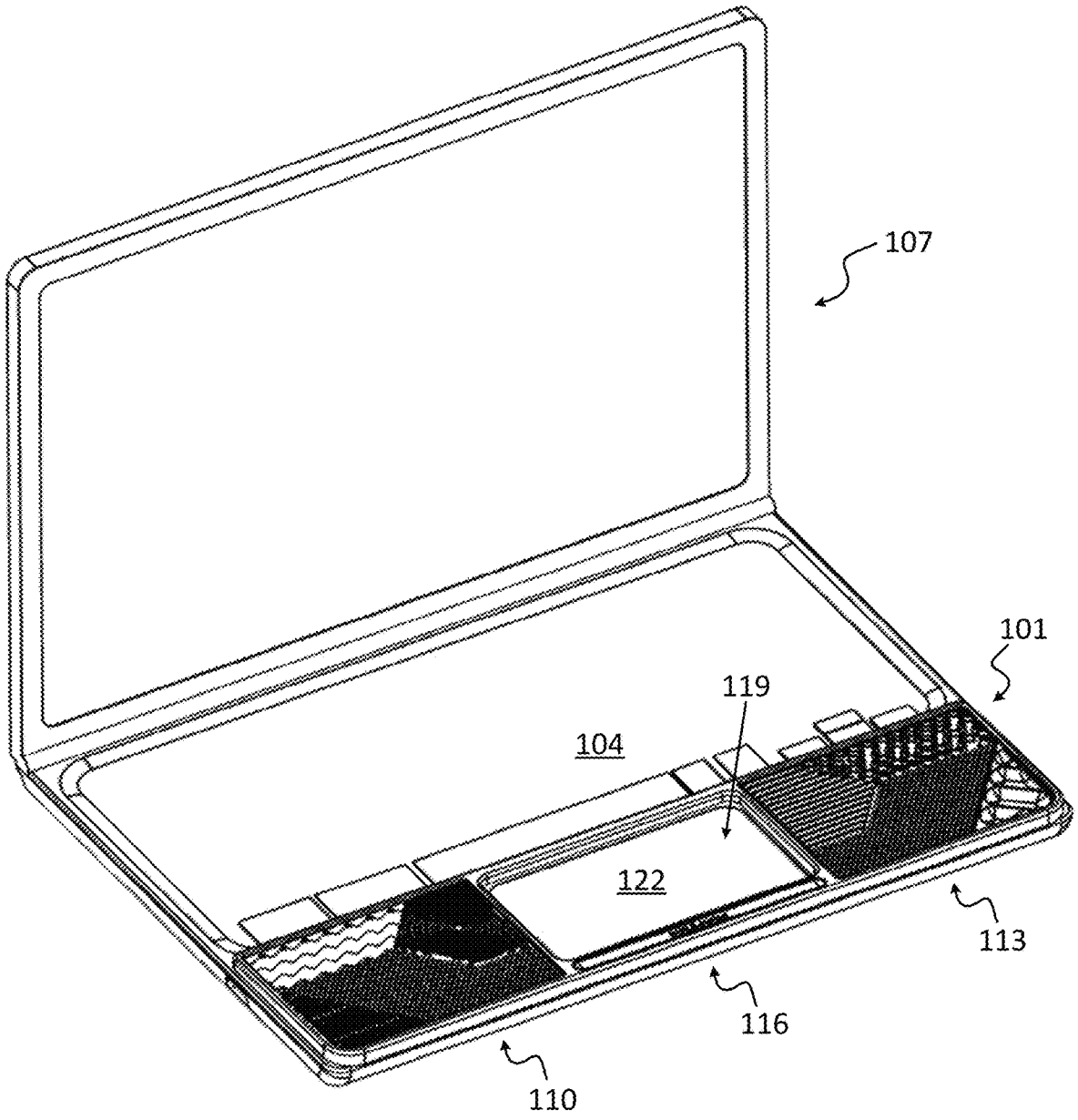
FIG. 1 is a perspective view of an exemplary sensory device, disposed on a computing device.

FIG. 1 is a perspective view of an exemplary sensory device 101 (e.g., a palm or wrist rest), disposed adjacent a keyboard 104 associated with a portable computing device 107. In the implementation shown, the sensory device 101 includes a left portion 110, a right portion 113, and a connecting region 116, which may include an opening 119 (e.g., to expose a track pad region 122 of the computing device 107). Other implementations may include only the left portion 110, or the right portion 113; and still other implementations may include both the left portion 110 and the right portion 113 but omit the connecting region 116. In implementations that are configured to be disposed adjacent the keyboard 104, an adhesive may be provided on the back of the sensory device 101, or a surface that is configured to contact the computing device 107 may have a sticky or high-friction surface that releasably couples the sensory device 101 to the computing device 107.

Figure 2:
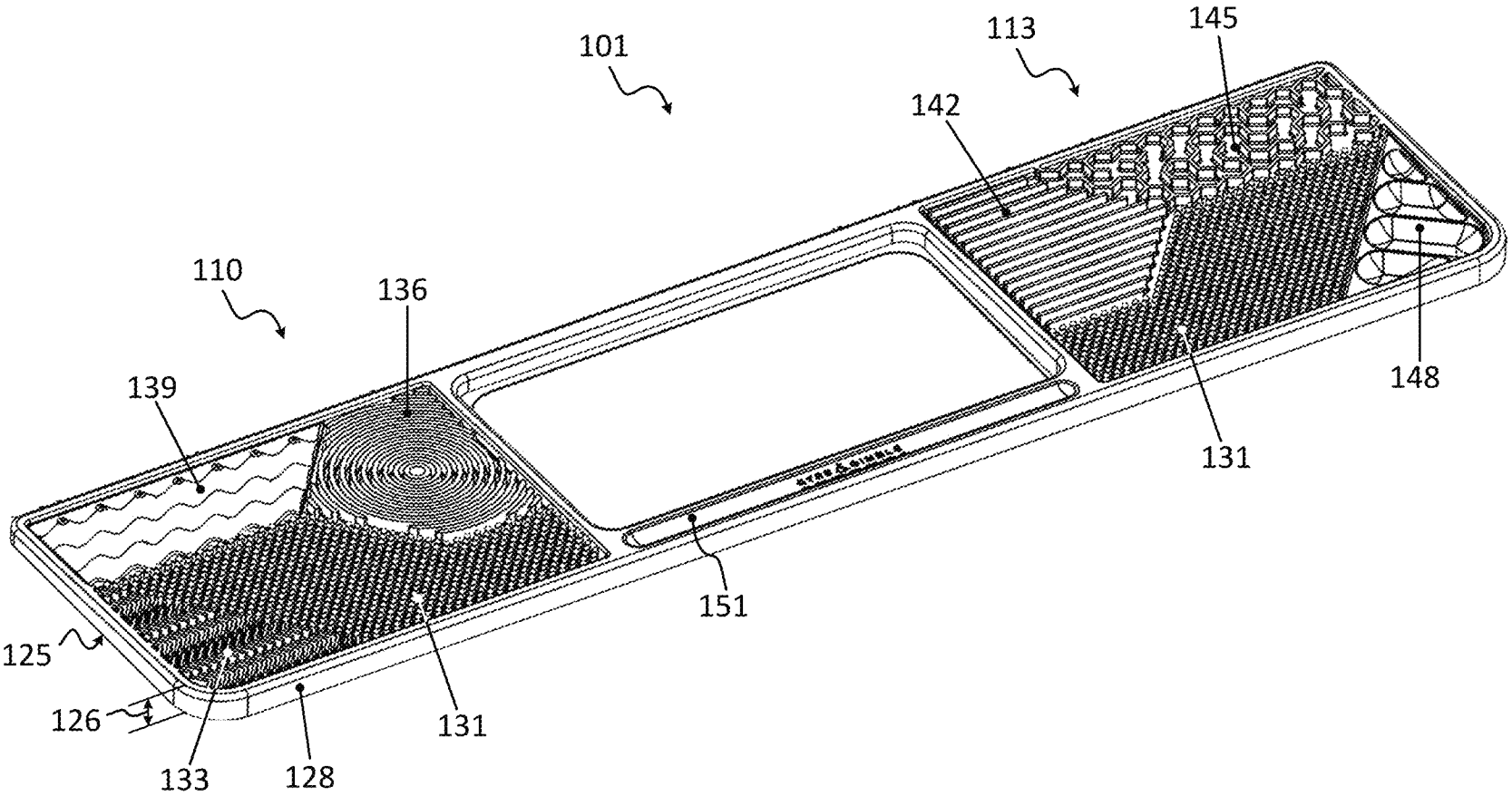
FIG. 2 is a perspective view of the exemplary sensory device of FIG. 1.

FIG. 2 is a perspective view showing additional detail of the exemplary sensory device 101 of FIG. 1. As shown, the device 101 includes a bottom surface 125 and a perimeter wall 128 that extends upward from the bottom surface 125 to a height 126. Within the perimeter wall 128, on each of the left portion 110 and the right portion 113, the device 101 includes various projections and surfaces that are arranged in sets or groups. For example, in the implementation that is shown, the device 101 includes a first set of projections 131 on both the left portion 110 and the right portion 113, a second set of projections 133, a third set of projections 136, a first contoured surface 139, a fourth set of projections 142, a fifth set of projections 145, a second contoured surface 148, and a third contoured surface 151.

In some implementations, as shown, one or more sets of projections may be repeated (e.g., projections 131, which appear on both the left portion 110 and the right portion 113). In other implementations, sets of projections and contoured surfaces may be arranged differently; but in general, implementations include a plurality of sets of different projections (e.g., sets of projections that are substantially similar within a set but distinct from other sets), or a plurality of different contoured surfaces.

Figure 3A:
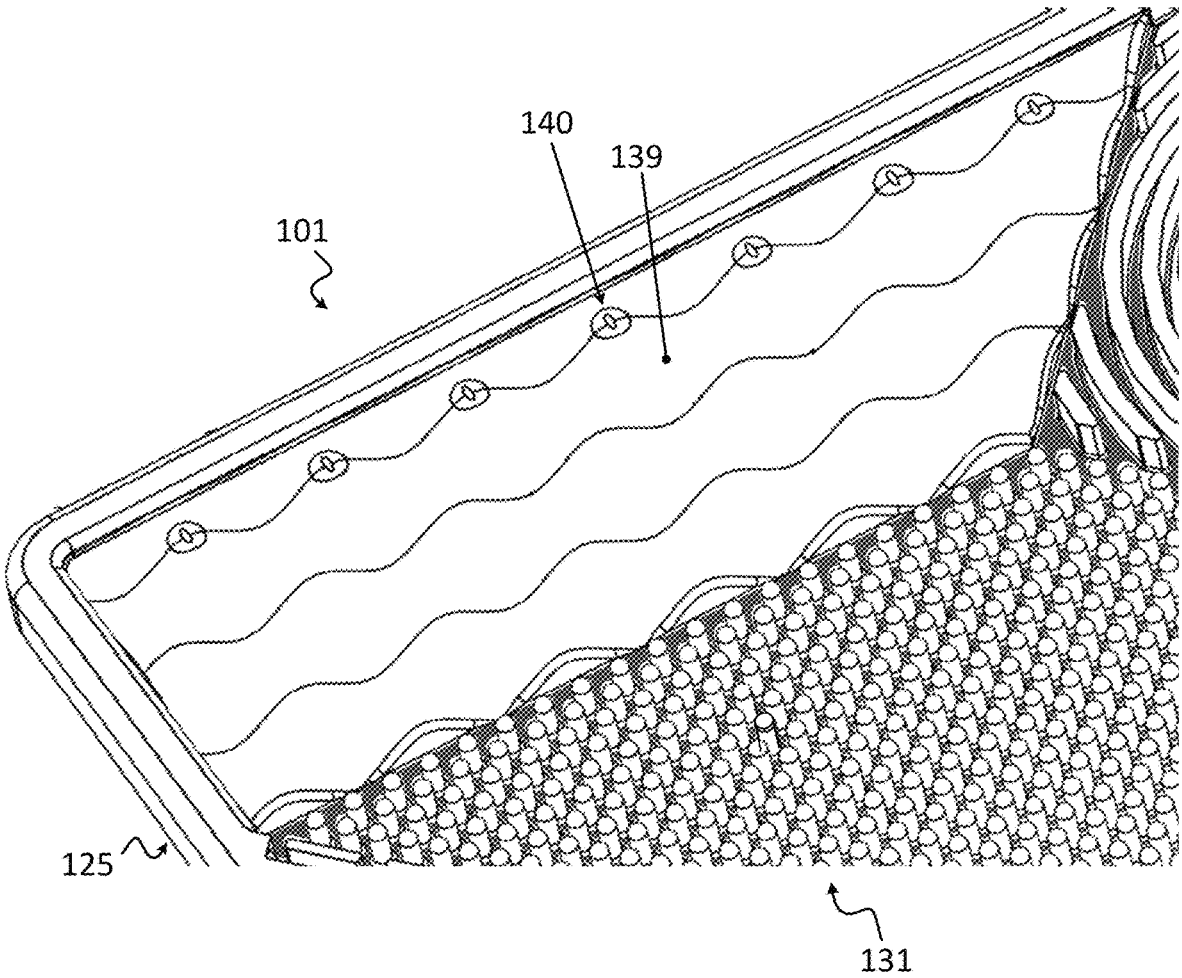
FIGS. 3A-3G illustrate various details of exemplary projections and contoured surfaces.
Figure 3B:
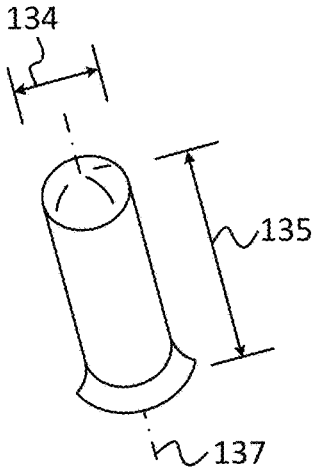

In some implementations, one or more of the various projections (e.g., projections 131, 133, 136, 142, and 145), or one or more of the contoured surfaces (e.g., surfaces 139, 148, and 151), may be made from an elastic and resilient material that enables the projections to be translated relative to the bottom surface 125 (or relative to an axis extending through the projection and normal to the bottom surface 125, such as the longitudinal axis 137 shown in FIG. 3B) or the contoured surfaces to be deformed temporarily relative to their nominal shape. In such implementations, a user may contact or manipulate the projections or contoured surfaces in various ways to provide different tactile sensations. For example, a user may drag his or her finger, fingernail, thumb, or knuckle across projections or contoured surfaces to produce particular tactile sensations; and the user may touch or push on projections or contoured surfaces to produce other tactile sensations. Different projections or contoured surfaces may evoke different, unique tactile sensations, and these different tactile sensations may evoke curiosity or satisfaction or bring about a calming or centering effect in some users. Moreover, manipulation of some projections (e.g., forceful translation and release of projections) may produce auditory feedback, and such auditory feedback may differ between each set of projections, depending on the geometry of those projections. These instances of different auditory feedback also may evoke curiosity or satisfaction or bring about a calming or centering effect.

For some users (e.g., users who have difficulty focusing or who are easily distracted), being able to touch or manipulate the projections or contoured surfaces to produce different tactile sensations (and in some implementations, produce different auditory feedback) may increase focus on other tasks and minimize other distractions. While this may be counterintuitive on its face—providing projections and contoured surfaces that are configured for interaction, which may themselves be seen as distractions—the tactile sensations and auditory feedback produced may become familiar to a user, and they may be interesting and engaging enough to the user that other less familiar and more random distractions in the environment may be minimized—increasing focus and providing a calming effect for some users.

FIGS. 3A-3G illustrate various projections and contoured surfaces in more detail. FIG. 3A illustrates an exemplary first contoured surface 139. In some implementations, the first contoured surface 139 may comprise wavy undulations that are smooth but of varied height relative to the bottom surface 125. Additional texture may be provided, such as localized bumps, ridges, pits, or other textural discontinuities 140. For some users of the device 101, moving their fingers along the first contoured surface 139, or pressing into and deforming portions of the surface 139, may produce therapeutic, calming, or other positive tactile sensations.

Figure 3C:
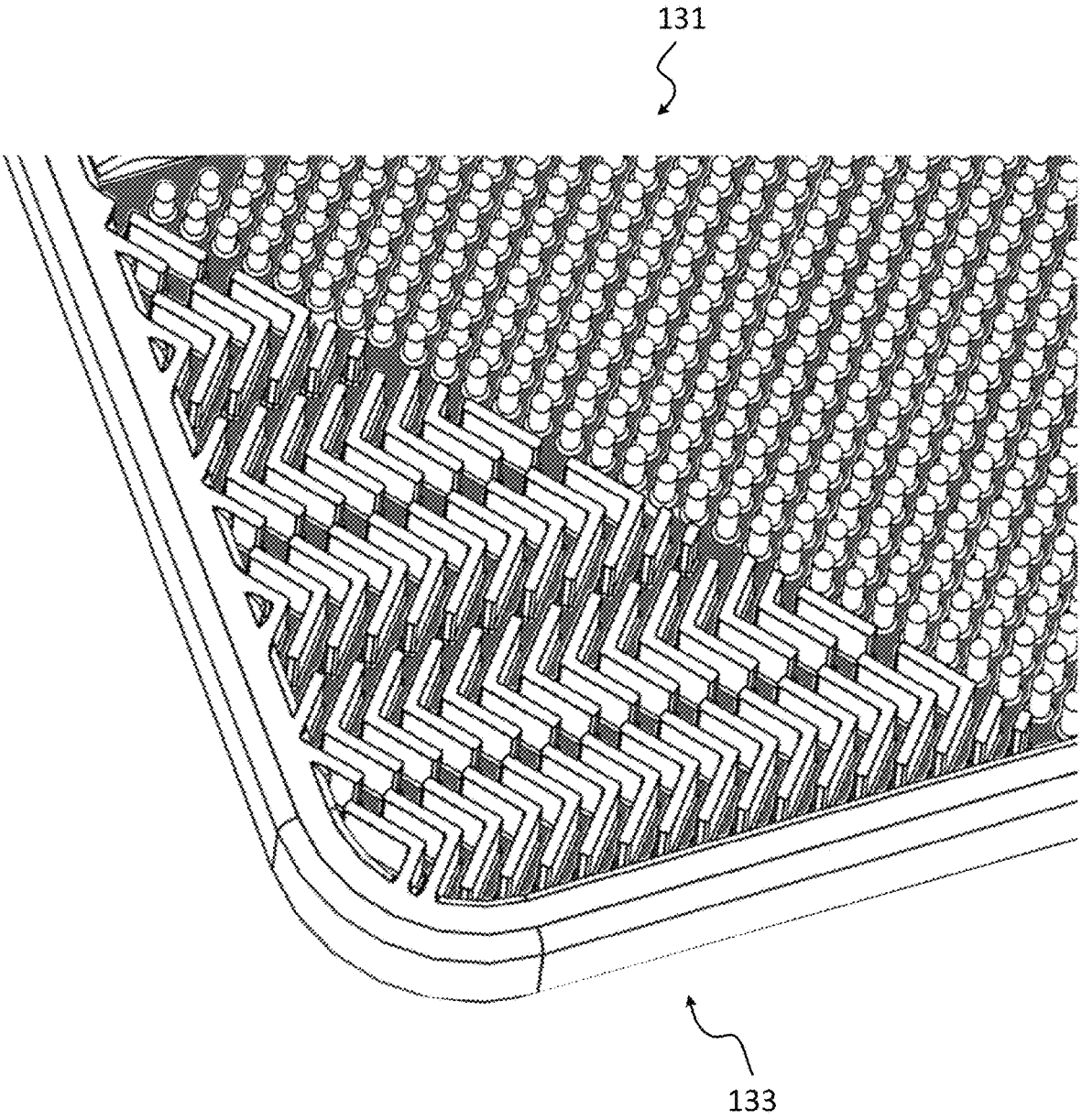

FIGS. 3A, 3B, and 3C illustrate an exemplary first set 131 of projections. As shown, the projections 131 may include cylinders having a substantially uniform diameter 134 or width and height 135 and being disposed in a repeating pattern. (As used herein, "about" "approximately" or "substantially" may mean within 1%, or 5%, or 10%, or 20%, or 50%, or 100% of a nominal value.) The cylinders may include rounded tops or other regular tops, and they may be made from an elastic and resilient material that enables the projections 131 to be translated relative to a longitudinal axis 137. When a user manipulates such projections 131 (e.g., by dragging his or her finger across the projections 131), a unique tactile sensation may be evoked. In some implementations, depending on the elasticity, resilience, and stiffness of the projections 131, translation and subsequent release of the projections 131 may produce audible feedback as well (e.g., a tone or sound whose frequency may depend on how fast the projections 131 are translated and released).

FIG. 3C further illustrates a second set of projections 133, which, as shown, may include a series of coupled linear segments—where each linear segment has a substantially uniform width and height and is coupled to and disposed relative to an adjacent segment at a fixed angle. In some implementations, the angle may be about 120 degrees; in other implementations, the angle may range between about 75 and about 150 degrees. The precise angle is not important, but by disposing adjacent linear segments at an angle relative to each other, each joined segment may resist translation more so than the projections 131. Accordingly, a tactile sensation may be produced in a user, when the user contacts or translates the projections 133, different from that produced when the user translates the projections 131. In addition, in some implementations, auditory feedback may also be produced, which audible feedback may be different from that produced by contact with or translation of the projections 131.

Figure 3D:
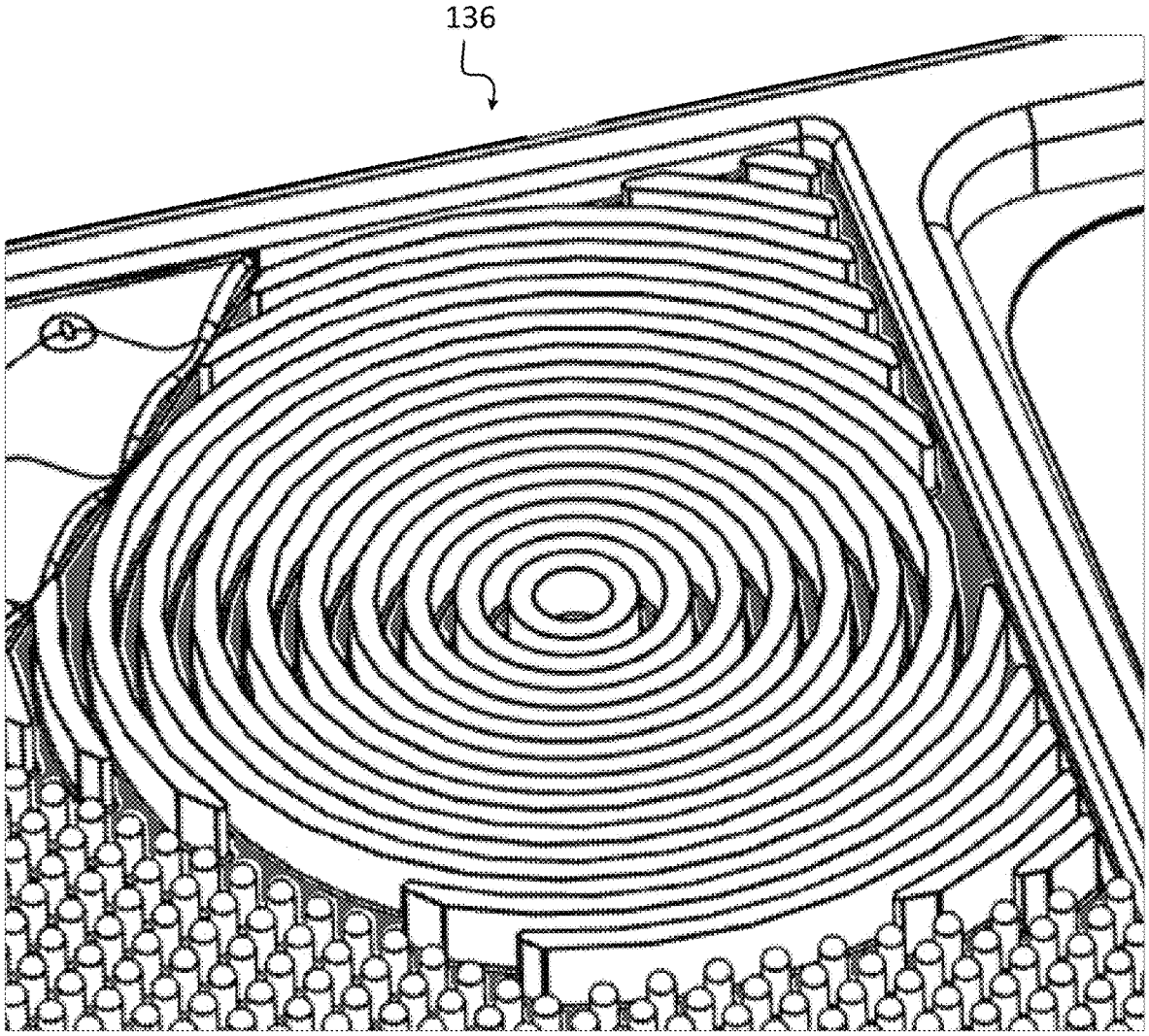

FIG. 3D illustrates a third set of projections 136. As shown, the third set of projections 136 may include projections 136 having a substantially uniform width and substantially uniform height and being disposed as concentric circles or arc segments. Because of the shape of these projections 136, they may provide further unique tactile sensations to a user who contacts them (e.g., by touching them or dragging his or her finger, fingernail, thumb, or knuckle across them); further, in some implementations, contact with or manipulation of the projections 136 may produce other unique auditory feedback.

Figure 3E:
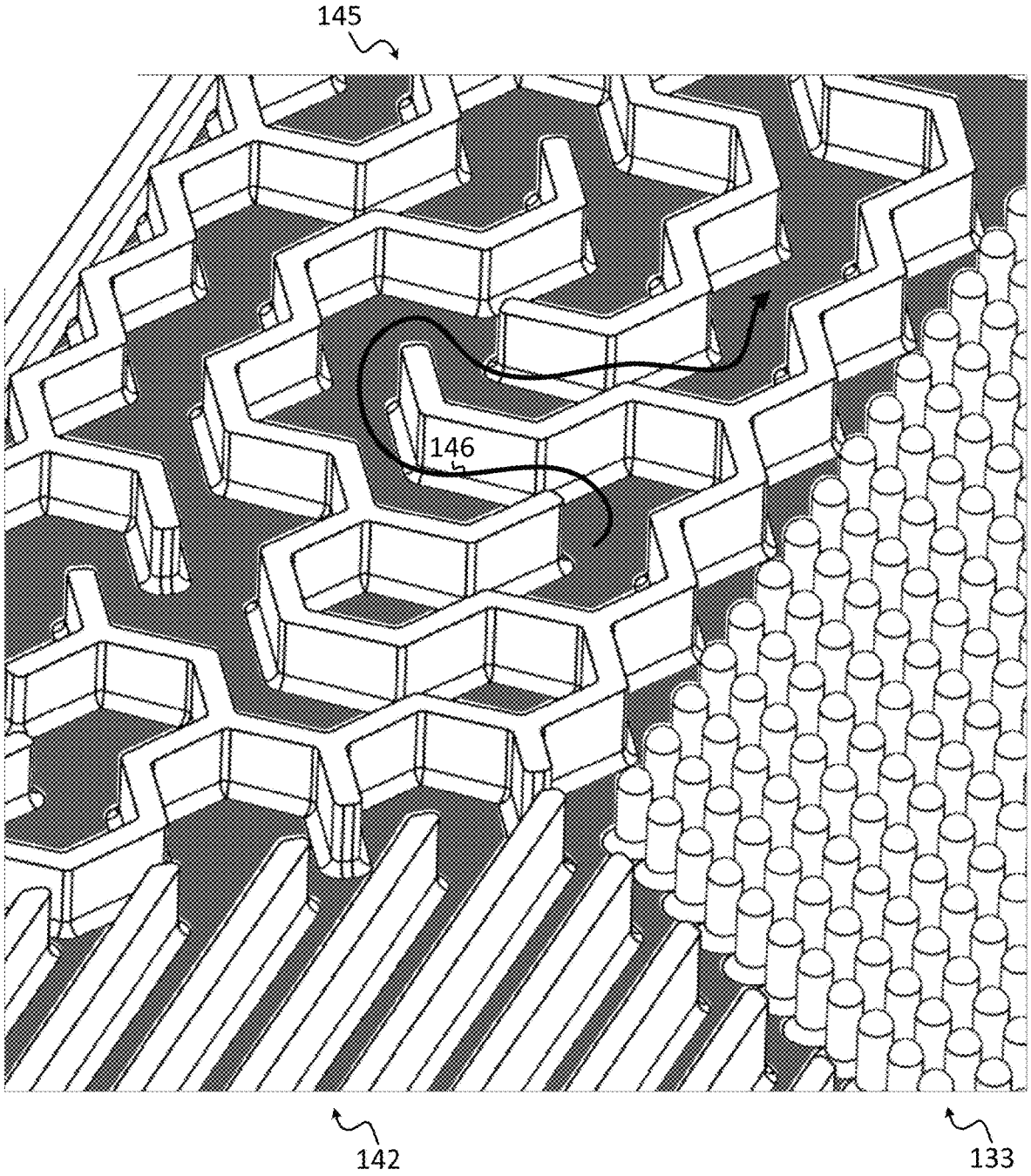

FIG. 3E further illustrates a fourth set of projections 142, and a fifth set of projections 145. As shown, the fourth set of projections 142 may include projections 142 that are configured as linear segments having a substantially similar width and height. In some implementations, the projections 142 are regularly spaced parallel to each other; in other implementations, the projections 142 may be spaced differently (e.g., not parallel to each other, not at regular intervals, etc.). As with other projections, manipulation or translation of the projections 142 may produce unique tactile sensations or auditory feedback.

A fifth set 145 of projections may include linear segments having a substantially uniform width and height; and such linear segments 145 may further have a substantially uniform length and be arranged at fixed angles relative to adjacent segments (e.g., 120 degrees). In some implementations, as shown, the segments 145 may be arranged as a partial "honeycomb," with various segments missing to create paths in a mazelike configuration. As with other projections, manipulation or translation of the projections 145 may produce unique tactile sensations or auditory feedback. The projections 145 may further engage a user in another unique way—in particular, a user may be drawn to "trace" different paths through the mazelike configuration (e.g., by running his or her finger along the open path area (e.g., path 146) between projections 145, or along the walls of the path created by the projections 145). Interaction with these projections 145 may involve a different region of a user's brain or activate a kind of thought or imagination different from interaction with other projections.

Figure 3F:
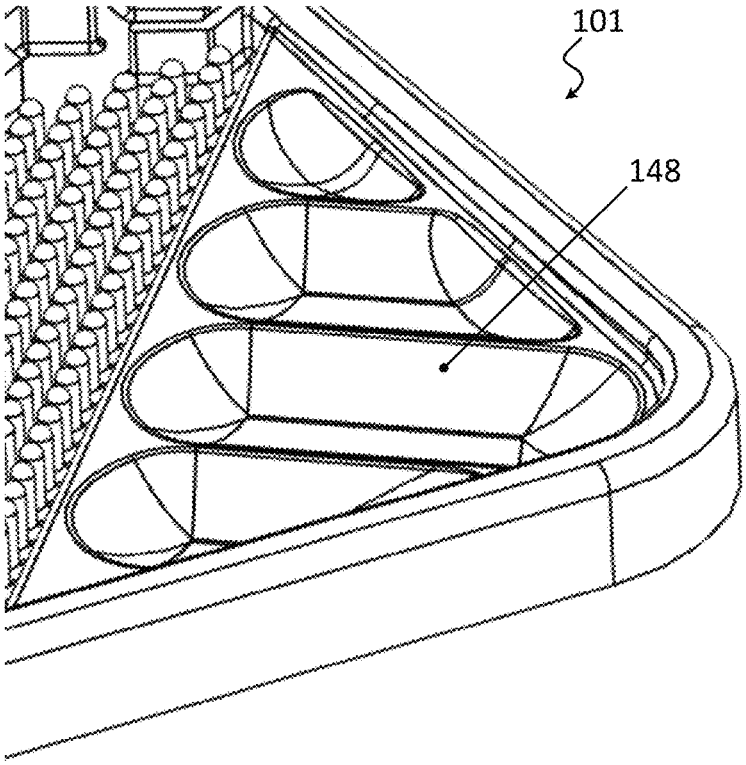

FIG. 3F illustrates a second contoured surface 148. As shown, the contoured surface 148 may include multiple depressions, such as depressions that include cylindrical or spherical surfaces, or segments thereof. As shown, the segments are disposed near a corner of the device 101, and some segments are truncated relative to others; but the segments may otherwise be uniform or similar in dimension (e.g., depth, radius of curvature, width, spacing, etc.). In some implementations, and for some users, there may be a draw to "trace" the contoured surfaces—thereby creating yet another tactile sensation and point of interest, curiosity, or attention.

Figure 3G:
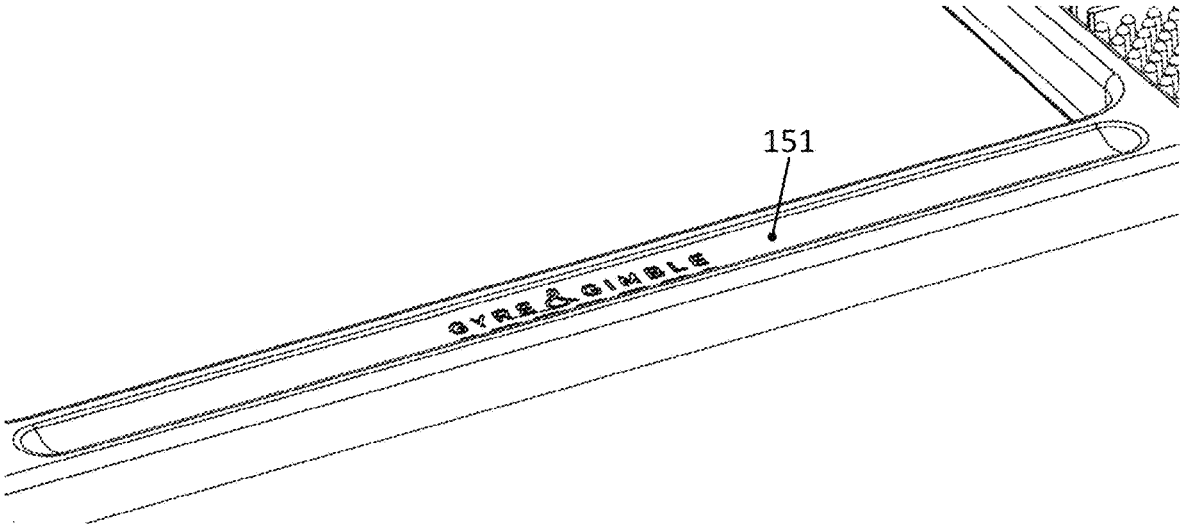

FIG. 3G illustrates a third contoured surface 151, which, as shown, may be similar to the second contoured surface 148. In particular, as shown, the contoured surface 151 may be cylindrical in nature with spherical ends. This surface 151, like the others, may draw users to interact by touching or tracing the surface 151 with their fingers. Moreover, depending on a length of the surface 151, it may facilitate retention of small objects (e.g., the surface may be useful for retaining, or partially retaining, a small pen, marker, pencil, or other object).

Figure 4:
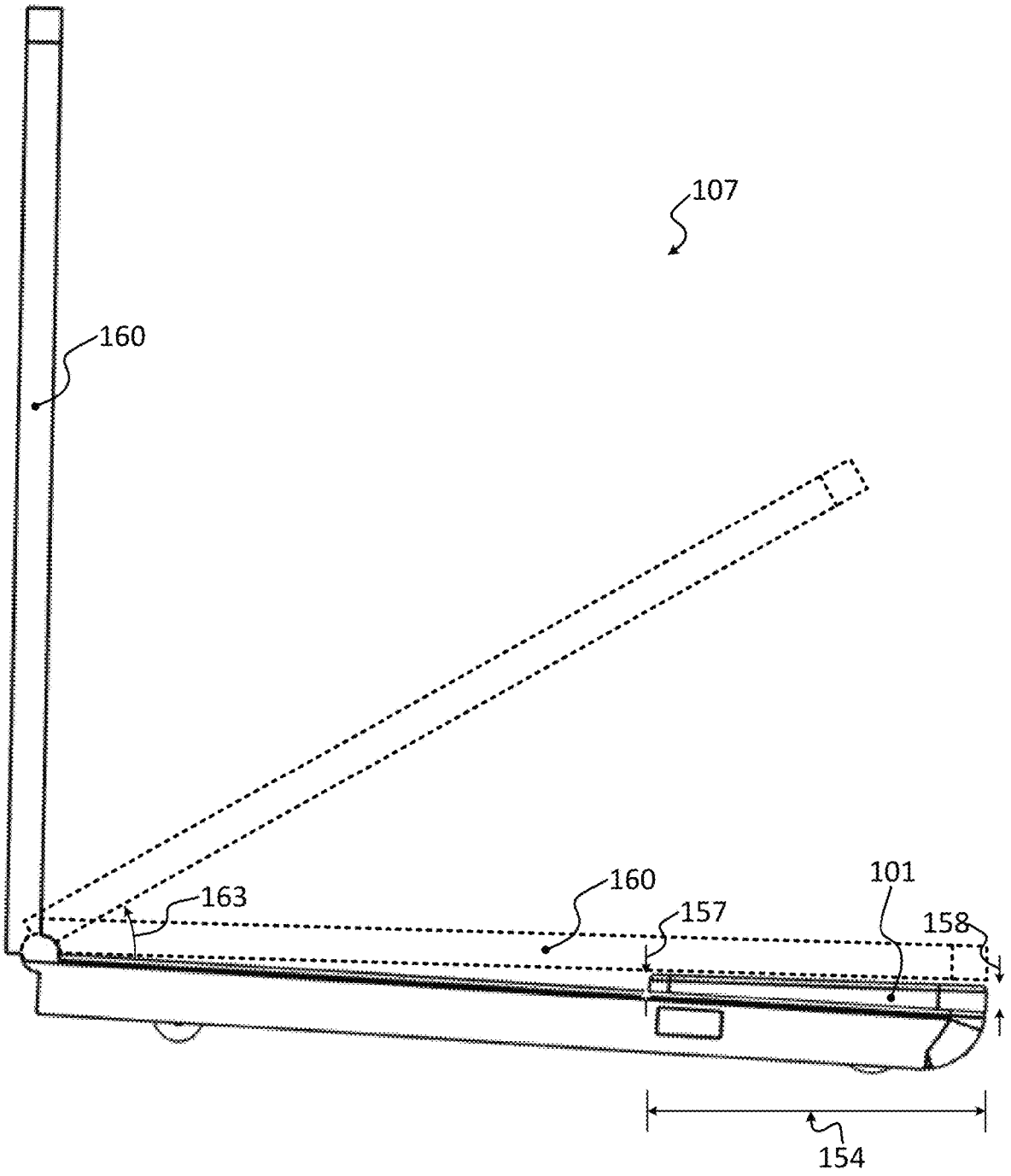
FIG. 4 depicts a variation in height across a width, in some implementations of a palm rest.

In some implementations, various projections may extend up from a bottom surface 125 to a substantially similar height, and that height (e.g., a "projection height") may be similar to the height 126 of the perimeter wall 128. In some implementations, as depicted in FIG. 4, the height of the perimeter wall 128 and the height of the projections may vary slightly across a width 154 (e.g., from a first height 157, to a second height 158 that is greater than the first height 157). In such implementations, such minor variation in height (from height 157 to height 158, across the width 154) may facilitate improved closing of a screen 160 of a computing device 107 on which the device 101 may be disposed. That is, by providing a shorter height 157, the screen 160 may be able to close to a greater extent (e.g., a lesser angle 163), than may be otherwise possible if heights 157 and 158 were uniform.

In some implementations, heights of projections ("projection height") and contoured surfaces are the same as or less than a corresponding height of the perimeter wall 128. For a system in which that height varies over its width, the height of projections may similarly vary, such that along any line parallel to a length of the device 101, heights of projections or contoured surfaces along that line are no higher than a corresponding section of the perimeter wall along that same line.

Several implementations have been described with reference to exemplary aspects, but it will be understood by those skilled in the art that various changes may be made and equivalents may be substituted for elements thereof without departing from the contemplated scope. For example, some implementations are described as a palm or wrist rest for use with a computing device, but other implementations may be configured for standalone use, apart from a computing device; some implementations include first and second portions, with a connecting region therebetween, while other implementations include only one portion or omit the connecting region; some implementations include multiple projections and contoured surfaces, while other implementations only include multiple projections only or multiple contoured surfaces only; various materials may be employed (e.g., silicone having varying hardnesses (e.g., Shore A durometers ranging from 0 to 80, or between 5 and 40, or between 45 and 65, or between 30 and 60), rubber, polymers, plastics, etc.); in some implementations, different projections or contoured surfaces may be made of different materials; few or many different contoured surfaces or projections may be provided; sets of projections or contoured surfaces may be repeated within a given textured surface; projections and contoured surfaces may be arranged differently than described and illustrated; other projections and contoured surfaces that provide tactile or auditory feedback may be employed; materials may have a single color, or multiple colors may be used to provide visual variation and interest; height may vary across a width, or height may be uniform.

Many other variations are possible, and modifications may be made to adapt a particular situation or material to the teachings provided herein without departing from the essential scope thereof. Therefore, it is intended that the scope include all aspects falling within of the appended claims.

What is claimed is:

1. A three-dimensional rest configured for use with a keyboard associated with a portable computing device, the three-dimensional rest comprising:

a bottom surface;

a perimeter wall protruding upward from the bottom surface to a perimeter height;

a plurality of projections extending upward from the bottom surface to a projection height, the plurality of projections comprising a first set of first projections, a second set of second projections, and a third set of third projections;

each of the first projections in the first set having a similar first structure, each of the second projections in the second set having a similar second structure, and each of the third projections in the third set having a similar third structure; the first structure, the second structure, and the third structure being distinct from each other in structure and each selected from a group comprising projections (a) being generally cylindrical in shape, (b) having a substantially uniform width and substantially uniform height and being disposed in a linear manner, (c) having a substantially uniform width and substantially uniform height and being disposed as a plurality of concentric circular segments, or (d) having a substantially uniform width and substantially uniform height and being disposed as a plurality of coupled linear segments, each linear segment in the plurality of coupled linear segments being disposed at a fixed angle relative to an adjacent linear segment in the plurality of coupled linear segments.

2. The three-dimensional rest of claim 1, wherein the fixed angle is 120 degrees.

3. The three-dimensional rest of claim 1, wherein the fixed angle is between 75 and 150 degrees.

4. The three-dimensional rest of claim 1, further comprising one or more contoured surfaces.

5. The three-dimensional rest of claim 1, wherein each projection in the plurality of projections comprises an elastic, resilient material.

6. The three-dimensional rest of claim 5, wherein the elastic, resilient material comprises silicone.

7. The three-dimensional rest of claim 6, wherein the silicone has a Shore A durometer of between about 30 and about 65.

8. The three-dimensional rest of claim 1, wherein a height relative to the bottom surface varies along a width, such that a height along one long edge has a first value, and a height along a second long edge opposite the first long edge has a second value, the second value being greater than the first value.

9. A three-dimensional rest configured for use with a keyboard associated with a portable computing device, the three-dimensional rest comprising:

a bottom surface;

a perimeter wall extending upward from the bottom surface to a perimeter height;

a plurality of projections extending upward from the bottom surface to a projection height, the plurality of projections comprising a first set of first projections, a second set of second projections, and a third set of third projections;

a first portion, a second portion, and a connecting region that couples the first portion to the second portion;

each of the first projections in the first set having a similar first structure, each of the second projections in the second set having a similar second structure, and each of the third projections in the third set having a similar third structure; the first structure, the second structure, and the third structure being distinct from each other and each selected from a group comprising projections (a) being generally cylindrical in shape, (b) having a substantially uniform width and substantially uniform height and being disposed in a linear manner, (c) having a substantially uniform width and substantially uniform height and being disposed as a plurality of concentric circular segments, or (d) having a substantially uniform width and substantially uniform height and being disposed as a plurality of coupled linear segments, each linear segment in the plurality of coupled linear segments being disposed at a fixed angle relative to an adjacent linear segment in the plurality of coupled linear segments.

10. The three-dimensional rest of claim 9, wherein the connecting region comprises an opening that is configured to reveal a track pad associated with the portable computing device.

11. A sensory device comprising:

a bottom surface;

a perimeter wall projecting upward from the bottom surface to a perimeter height;

a plurality of projections extending upward from the bottom surface to a projection height, the plurality of projections comprising a first set of first projections, a second set of second projections, and a third set of third projections;

each of the first projections in the first set having a similar first structure, each of the second projections in the second set having a similar second structure, and each of the third projections in the third set having a similar third structure; the first structure, the second structure, and the third structure being distinct from each other and each selected from a group comprising projections (a) being generally cylindrical in shape, (b) having a substantially uniform width and substantially uniform height and being disposed in a linear manner, (c) having a substantially uniform width and substantially uniform height and being disposed as a plurality of concentric circular segments, or (d) having a substantially uniform width and substantially uniform height and being disposed as a plurality of coupled linear segments, each linear segment in the plurality of coupled linear segments being disposed at a fixed angle relative to an adjacent linear segment in the plurality of coupled linear segments.

12. The sensory device of claim 11, wherein the fixed angle is 120 degrees.

13. The sensory device of claim 11, wherein the fixed angle is between 75 and 150 degrees.

14. The sensory device of claim 11, further comprising one or more contoured surfaces.

15. The sensory device of claim 11, where each projection in the plurality of projections comprises an elastic, resilient material.

16. The sensory device of claim 15, wherein the elastic, resilient material comprises silicone.

17. The sensory device of claim 16, wherein the silicone has a Shore A durometer of 30-65.

* * * * *